US007828138B2

(12) United States Patent
Stukenkemper

(10) Patent No.: US 7,828,138 B2
(45) Date of Patent: Nov. 9, 2010

(54) CASE

(75) Inventor: Heinrich Stukenkemper, Castrop-Rauxel (DE)

(73) Assignee: Faber-Castell AG, Stein (DE)

( * ) Notice: Subject to any disclaimer, the term of this patent is extended or adjusted under 35 U.S.C. 154(b) by 254 days.

(21) Appl. No.: 12/131,601

(22) Filed: Jun. 2, 2008

(65) Prior Publication Data

US 2008/0296180 A1 Dec. 4, 2008

(30) Foreign Application Priority Data

May 31, 2007 (DE) ..... 10 2007 025 547

(51) Int. Cl.
*A45C 11/34* (2006.01)

(52) U.S. Cl. ..... 206/214; 206/224; 206/371

(58) Field of Classification Search ..... 206/214, 206/224, 232, 371, 443, 475, 575, 775–778; 40/781, 791, 797
See application file for complete search history.

(56) References Cited

U.S. PATENT DOCUMENTS

| | | | | |
|---|---|---|---|---|
| 4,361,227 | A * | 11/1982 | Paulucci | 206/777 |
| 4,717,023 | A * | 1/1988 | Oprean | 206/459.5 |
| 4,991,980 | A | 2/1991 | Cohen et al. | |
| 5,234,108 | A | 8/1993 | Jorgensen | |
| 5,690,220 | A * | 11/1997 | Swan | 206/775 |
| 5,718,336 | A * | 2/1998 | Haarlander | 206/232 |
| 5,817,353 | A * | 10/1998 | Guarino | 206/778 |
| 6,047,819 | A * | 4/2000 | Borst et al. | 206/232 |
| 6,488,433 | B2 * | 12/2002 | Wien et al. | 402/73 |
| 6,854,915 | B1 * | 2/2005 | Ong | 206/776 |
| 7,296,665 | B2 | 11/2007 | Morszeck | |
| 2006/0201764 | A1 | 9/2006 | Morszeck | |

FOREIGN PATENT DOCUMENTS

| | | |
|---|---|---|
| CN | 2797245 Y | 7/2006 |
| DE | 20306647 U1 | 9/2004 |
| FR | 1131228 | 2/1957 |

* cited by examiner

*Primary Examiner*—Luan K Bui
(74) *Attorney, Agent, or Firm*—Laurence A. Greenberg; Werner H. Stemer; Ralph E. Locher

(57) ABSTRACT

A case, in particular for writing utensils, has a shell-like lower part and a shell-shaped upper part. The two parts are pivotally connected to one another. The upper part has a viewing window. A holding device for a decorative material blank is disposed on the inner side aligned with and covering the viewing window on the inside.

8 Claims, 11 Drawing Sheets

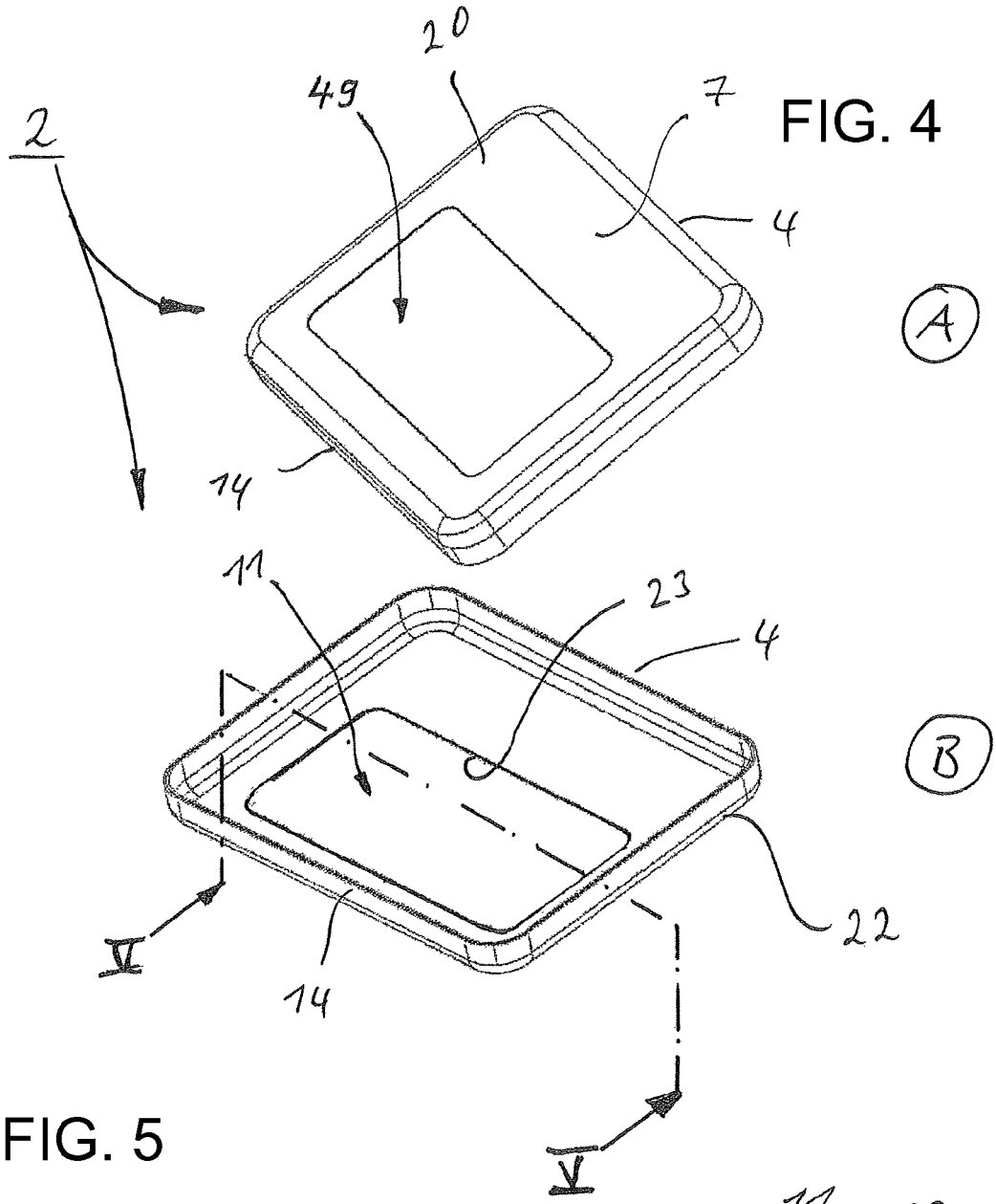
FIG. 4
FIG. 5
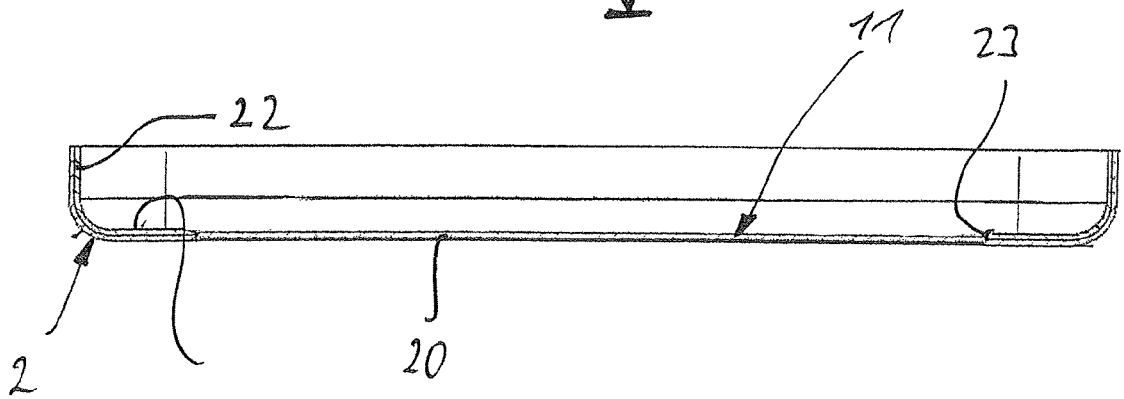

CASE

CROSS-REFERENCE TO RELATED APPLICATION

This application claims the priority, under 35 U.S.C. §119, of German application DE 10 2007 025 547.2, filed May 31, 2007; the prior application is herewith incorporated by reference in its entirety.

BACKGROUND OF THE INVENTION

Field of the Invention

The invention relates to a case, in particular for writing utensils, with a shell-like lower part and a shell-shaped upper part which is coupled to the latter. The surface of cases of this type is generally provided with a decoration. Many users, in particular pupils and students, require an individual design, but this is almost impossible to realize in conventional cases.

SUMMARY OF THE INVENTION

It is accordingly an object of the invention to provide a case, which overcomes the above-mentioned disadvantages of the heretofore-known devices and methods of this general type and which provides for a case, especially for writing utensils, which permits individualization in terms of design.

With the foregoing and other objects in view there is provided, in accordance with the invention, a case, especially a case for writing utensils, comprising:

a shell-shaped lower part and a shell-shaped upper part connected to said lower part;

said upper part having a viewing window formed therein; and a holding device for a decorative material blank disosed on an inner side of said upper part and substantially covering said viewing window on an inside thereof.

In other words, the objects of the invention are achieved with a case having a viewing window in the upper part and wherein, on the inner side of the upper part, there is a holding device for a decorative material blank which covers the viewing window on the inside. Differently designed blanks made of paper, cardboard or plastic can be inserted as decorative material into the holding device, as a result of which the case can be provided with an individual touch. The easy interchangeability of the decorative material enables the user to follow current trends, for example enables him to fit images of known individuals, emblems of football clubs and the like in the viewing window.

In accordance with an added feature of the invention, the holding device has a separate film blank which is fixed to the inner side of the upper part, the space between said film blank and the viewing window serving to receive the decorative material.

In accordance with an additional feature of the invention, the holding device is a separate insertion pocket which is fixed to the inner side of the upper part, is formed from two film blanks and the interior space of which serves to receive the decorative material.

Preferably, the holding device is dimensioned in such a manner that it can receive a decorative material, the length and width of which are greater than the corresponding dimensions of the viewing window.

In accordance with another feature of the invention, the upper part is a single piece and is composed of a transparent material, the inner or outer side of the upper part, with an area forming the viewing window being left free, being provided with a coating which is less transparent than the material of the upper part.

In accordance with a further feature of the invention, the upper part is a single piece and is composed of a material which has a lower degree of transparency than air, the viewing window being formed by an opening which breaks through the upper part.

In accordance with again an added feature of the invention, the upper part is formed from two shells, namely from an outer shell composed of a transparent material and from an inner shell, the inner shell having a lower degree of transparency than the outer shell and being broken through by an opening which forms the viewing window.

In accordance with again an additional feature of the invention, the upper part is passed through by an opening which forms the viewing window and is closed by an insert formed from a transparent flat material.

In accordance with again another feature of the invention, the insert has an inner region which projects in an accurately fitting manner into the opening and merges with a step into a flange surrounding it, the flange bearing on the inside against the border region of the opening. Preferably, the height of the step approximately corresponds to the thickness of the border region. In a further development, tabs are formed integrally on the border region, said tabs passing through slots in the flange of the insert and engaging behind the flange.

In accordance with again a further feature of the invention, the edge of the opening is offset toward the interior of the upper part and forms a flange which carries the insert. In a preferred implementation, the insert is fixed in the opening with the aid of a frame which is placed onto the outer side of the upper part and has a contour shape which corresponds to the insert, with tabs being integrally formed on the lower side of the frame, which side faces into the interior of the upper part, said tabs passing through slots in the insert and engaging behind the flange. Preferably, the offset of the flange is approximately the same size as the sum of the thicknesses of insert and frame.

In accordance with yet an added feature of the invention, the holding device is formed by a wall which is integrally formed on the inner side of the upper part, runs essentially parallel to the flat plane of the upper part and between it and the inner side of the upper part leaves free an intermediate space which serves to receive the decorative material. The upper part may be formed of two shells, namely an outer shell which is composed of a transparent material and an inner shell which has a lower degree of transparency than the outer shell, the inner shell containing a recess which opens toward the outer shell and the base of which forms the wall.

In accordance with a concomitant feature of the invention, the upper part and, if appropriate, the outer and inner shells forming it are thermoformed parts made of plastic Other features which are considered as characteristic for the invention are set forth in the appended claims.

Although the invention is illustrated and described herein as embodied in case, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 4 shows an upper part formed from an outer shell (A) and an inner shell (B);

FIG. 5 is a section taken through an upper part along the line V-V in FIG. 4;

DETAILED DESCRIPTION OF THE INVENTION

Figure 1:
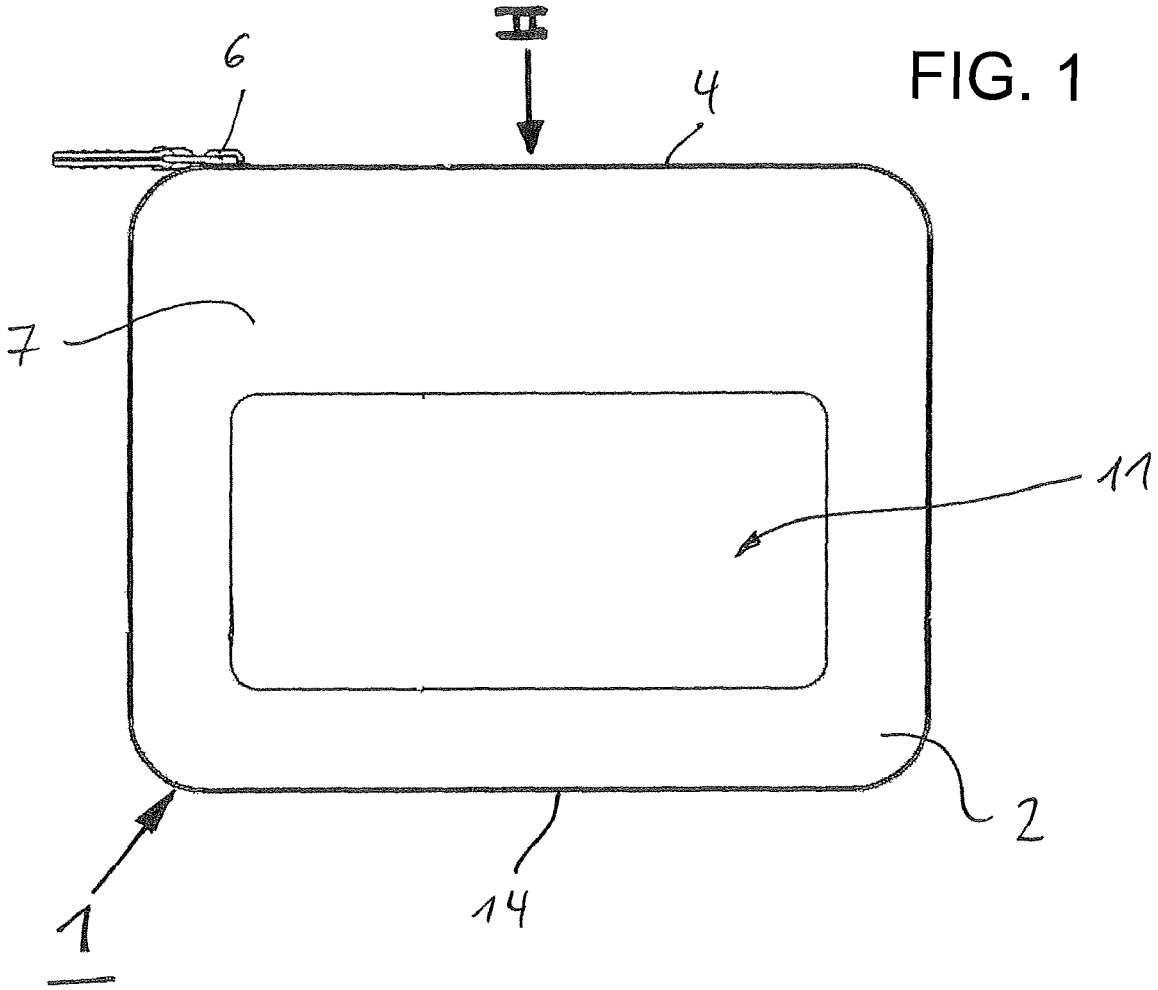
FIG. 1 shows the top view of a case from the upper side thereof.
Figure 2:
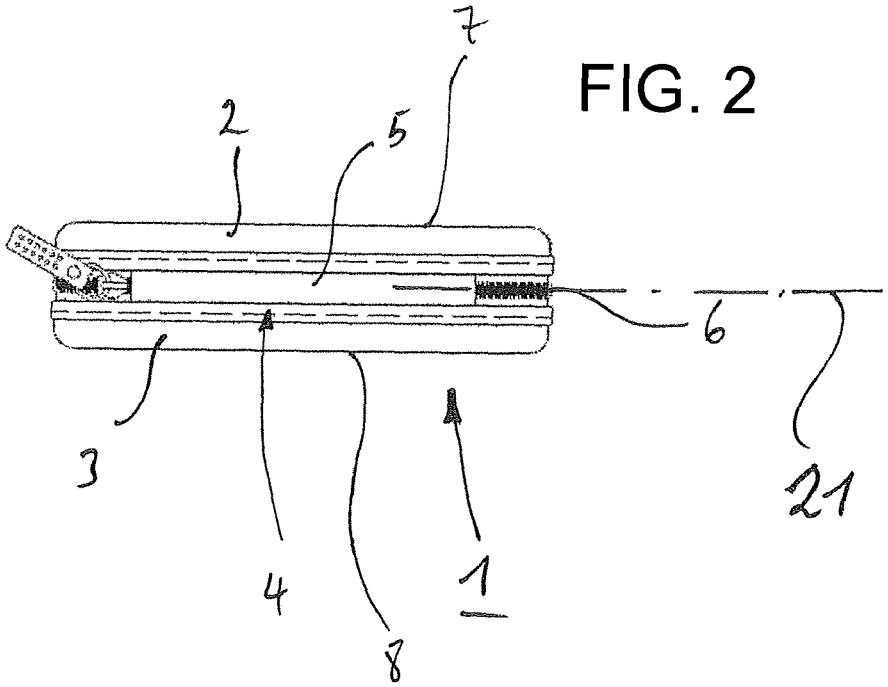
FIG. 2 shows a side view in the direction of the arrow II in FIG. 1.

Referring now to the figures of the drawing in detail and first, particularly, to FIGS. 1 and 2 thereof, the novel case 1 has an approximately rectangular contour shape and an approximately shell-shaped upper part 2 and a similar lower part 3. The shapes of the parts may also be described as a flat tray or a flat shell. The two parts 2, 3 are pivotally connected to each other on their rear side via an elastic material strip 5, for example a fabric tape, with the common pivot axis 21 running parallel to the flat plane of the lower part 3. The material strip 5 extends over a central region of the rear side 4, with a zip fastener or zipper 6 adjoining it on both sides. The case has the overall shape of a cuboid, i.e., the outer sides 7, 8 of the upper and lower parts 2, 3 run substantially parallel to each other. There is an approximately rectangular viewing window 11 in the upper part 2. The case 1 furthermore has a holding device 9, which is described in more detail further below, for a decorative material approximately in the form of a paper, cardboard or plastic film blank. Two different variant embodiments are produced with regard to the holding device. In the one variant embodiment, the holding device is a separate part fixed to the inner side of the upper part 2. In the other variant embodiment, the holding device is formed as a single piece with the upper part or an inner shell of the upper part.

Figure 3:
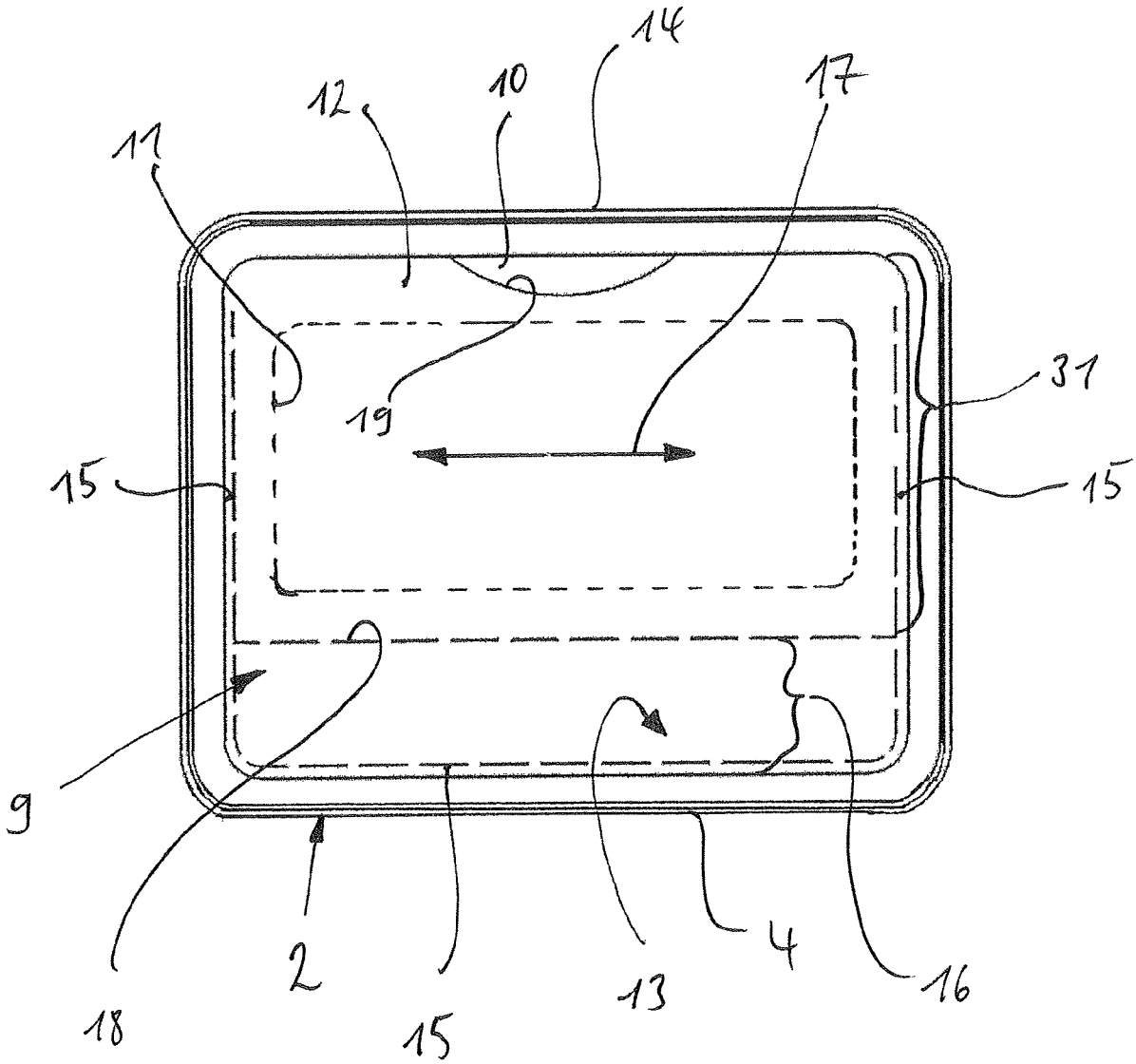
FIG. 3 shows the top view of an upper part from the inner side thereof, with a holding device which is designed as a separate part being fixed to the inner side.
Figure 7:
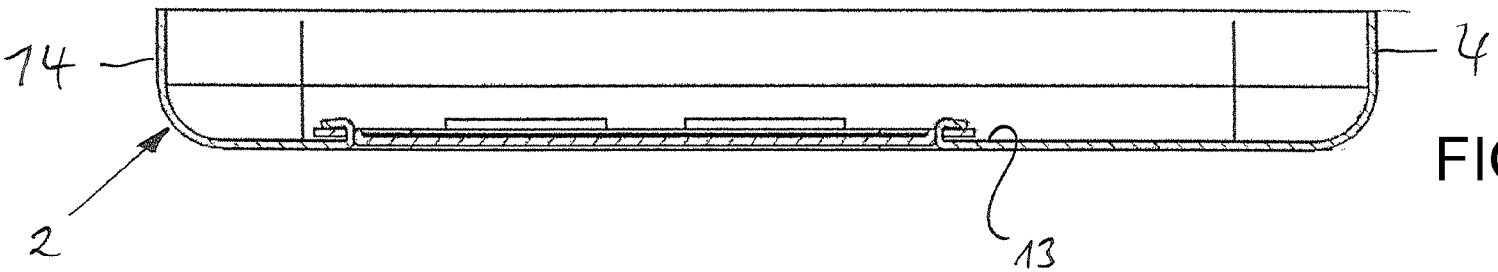
FIG. 7 is a section taken along the line VII-VII in FIG. 6.
Figure 6:
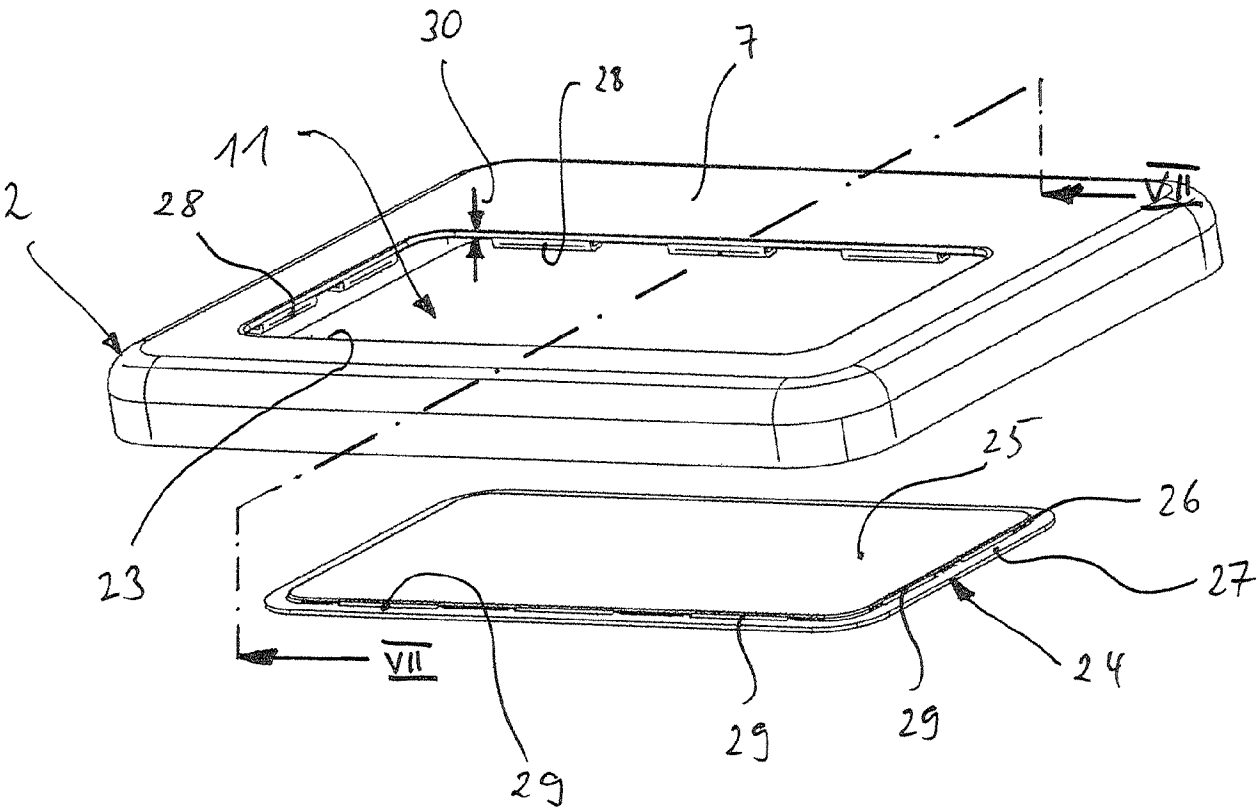
FIG. 6 shows a further exemplary embodiment of an upper part in a perspective view.

FIG. 3 shows an upper part 2 to which a holding device 9, which is designed as a separate part, for a decorative material (not illustrated in the figures) is fixed. The holding device 9 is formed from two film blanks 10, 12, which have a contour shape and size approximately corresponding to the inner side 13 of the upper part 2. The two films, which are larger than the viewing window 11, completely cover the latter. Apart from the borders running in the vicinity of the front side 14 of the upper part 2, the remaining borders of the film blanks 10, 12 are connected to each other via a weld seam 15. A region 16 of the film blank 10, which rests directly on the inner side 13 of the upper part 2, which region is arranged between the viewing window 11, which is offset toward the front side 14, and the rear side 4, is fixed to said inner side, for example by means of welding or adhesive bonding which region is arranged between the viewing window 11, which is offset toward the front side 14, and the rear side 4. The film blanks 10, 12 are also fixed to each other in the region 16. The border between the region 16 and the remaining regions of the film blanks 10 forms a bending line 18 which extends in the longitudinal direction 17 of the upper part 2 and of the case 1. The film blanks 10, 12 and the insert pocket 31 formed by the latter can fold away from the inner side 13 along said bending line, thus making it easier to insert decorative material between the film blanks 10, 12. The insertion is facilitated by the film blank 12 having a recess 19 on its border in the vicinity of the front side 14.

In the case of the exemplary embodiment described and the exemplary embodiments explained in more detail further below, it is basically conceivable to produce the upper and lower parts 2, 3 by injection molding. However, the case should be designed to have as thin walls as possible, so that it firstly feels soft and secondly, because of its flexibility, can break only with difficulty, for example if it is dropped. Thin-walled parts can then only be produced with great difficulty by injection molding. The upper part 2 and the lower part 3 of a case 1 according to the invention are therefore manufactured as thermoformed parts, i.e. a plastic film, for example made of PP or PET, is pressed into a mold with the aid of a thermoforming ram, with the plastic being heated and in the process being able to be deformed. There are various possibilities for producing a viewing window during such a manner of production. First of all, it is conceivable for a transparent plastic film to be processed by thermoforming to form an upper shell 2 and, following this, for said upper shell to be provided with a coating, for example by screen printing, with the viewing window 11 being left free. The coated or printed regions are then only slightly transparent, if at all, or are opaque. A different possibility is to produce an upper shell from a film material which has a lower degree of transparency than air and, for example, by adding color pigments or dyes, has a certain degree of opaqueness or is completely impermeable to light. The viewing window is then formed in a simple manner by a corresponding opening being present in the upper shell. Said opening can already be provided in the original film which is yet to be thermoformed, or can be placed into the subsequent, thermoformed upper part 2.

In the exemplary embodiment shown in FIG. 4, the upper part 2 comprises two shells which are placed one inside the other, namely an outer shell 20 and an inner shell 22. The inner shell 22 has a lower degree of transparency than the outer shell 20 which is preferably formed from a fully transparent material. The inner shell 22 is broken through by an opening 23 which forms the viewing window 11. In the assembled state, the outer shell 20 covers said opening. This gives rise to a viewing window 11 which is completely covered and is completely free from joints into which dirt particles can penetrate. The outer shell 20 and inner shell 22 are joined fixedly to each other, for example by means of an adhesive bond or a welding, for example an ultrasonic welding.

FIGS. 6 to 9 show a further configuration of an upper shell 2 with a viewing window. The upper part here is preferably a single-piece thermoformed part which is broken through by an opening 23 which forms the viewing window 11. Said opening is closed by an insert 24 formed from transparent flat material. The insert 24 has an inner region 25 which projects in accurately fitting manner into the opening 23 and merges with a step 26 into a flange 27 surrounding it. In the fitted state, the flange 27 bears against the inner side 13 of the upper part or of the border region of the upper part 2, which region surrounds the opening 23. A plurality of tabs 28 are integrally formed on the said border region, said tabs passing through slots 29 in the flange 27 and engaging behind the flange 27. In the fitted state, the insert 24 is aligned with the outer side 7 of the upper part 2. This is ensured by the height of the step 26 corresponding to the thickness 30 of the border region of the upper part 2, which region surrounds the opening 23.

Figure 9:
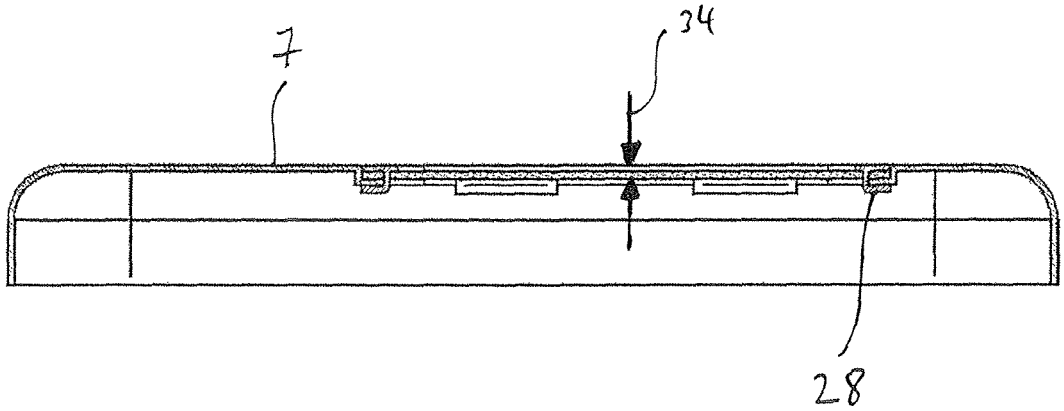
FIG. 9 is a section taken along the line IX-IX in FIG. 8.
Figure 8:
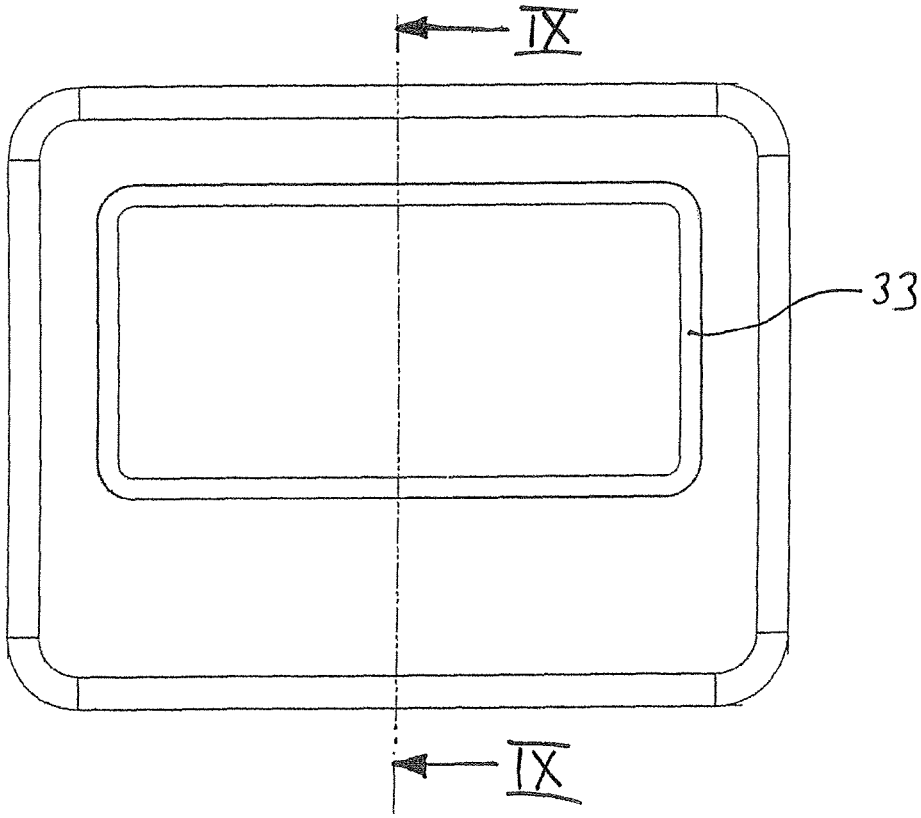
FIG. 8 shows a further exemplary embodiment for an upper part in top view.
Figure 10:
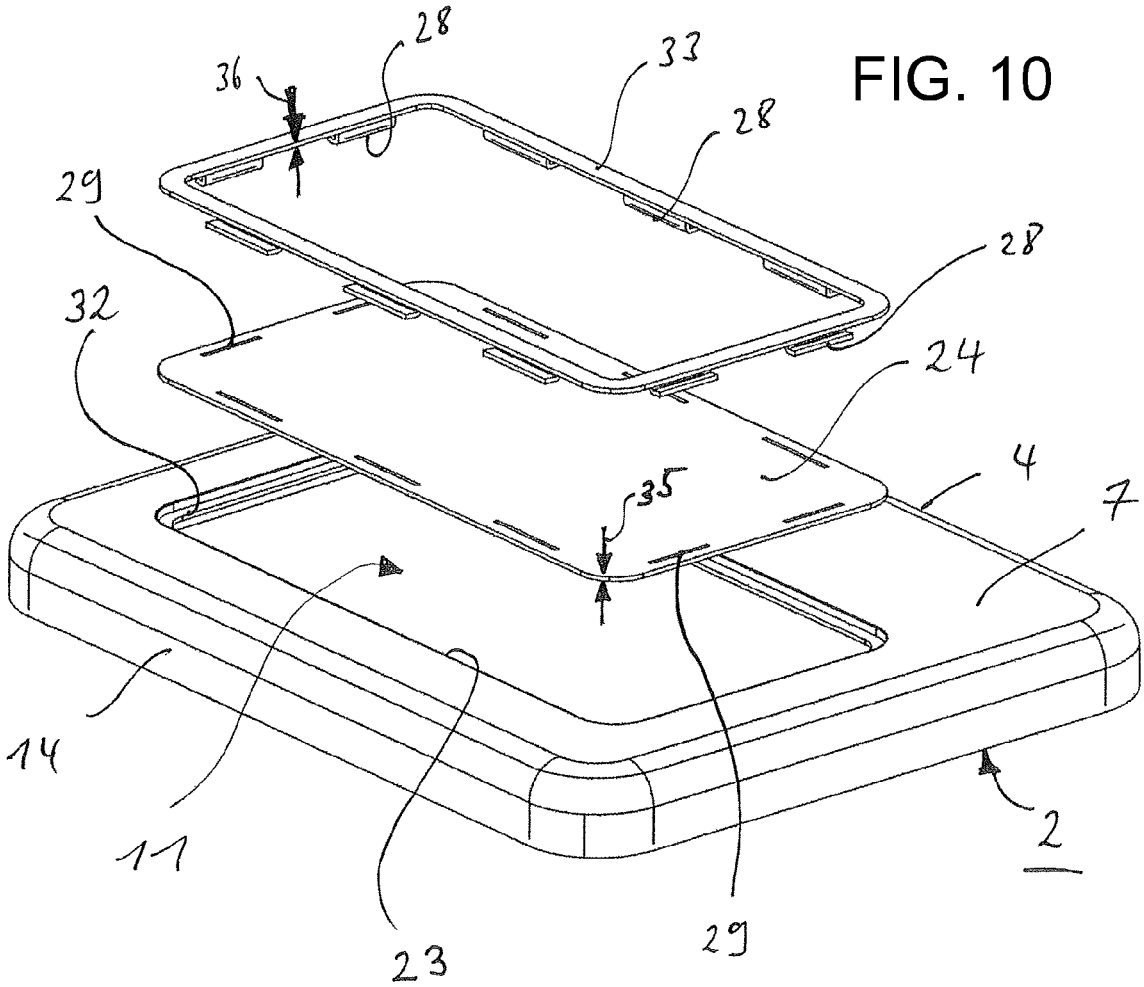
FIG. 10 shows a perspective exploded illustration of the upper part of FIGS. 8 and 9.

A further example of realizing a viewing window 11 in an upper part 2 is shown in FIGS. 8 to 10. The upper part 2 is likewise passed through here by an opening 23 which forms the viewing window 11. However, the border of the opening is offset toward the interior of the upper part 2 and forms a flange 32 which carries the insert 24. The insert 24 is fixed from the outer side 7 of the upper part 2 by means of a frame 33 in the opening 23, said frame having a contour shape which corresponds to the insert 24. Tabs 28 are integrally formed on the lower side of the frame 33, which side faces the interior of the upper part 2 in the fitted state, said tabs passing through slots 29 in the insert 24 and engaging behind the flange 32. The offset 34 of the flange 32 is dimensioned in such a manner that it corresponds to the sum of the thickness 35 of the insert 24 and the thickness 36 of the frame 33. This ensures that the frame 33 is aligned with the outer side 7 of the upper part 2.

In the exemplary embodiments described below according to FIGS. 11-18, the holding device 9*a* is not a separate part but rather is integrally formed on the inner side 13 of the upper part 2. In entirely general terms, said holding device is formed by a wall 39, 39*a* which is integrally formed on the inner side 13 of an upper part 2, said wall running essentially parallel to the flat plane of the upper part 2 or to the outer side 7 thereof and between it and the inner side of the upper part leaving free an intermediate space 37 which serves to receive a decorative material. As also in the exemplary embodiments described further above, the upper part 2 is formed as a single piece or from two shells, namely from an outer shell 20 composed of a transparent material and from an inner shell 22 which has a lower degree of transparency than the latter. A recess 38 (also see FIG. 15B) which opens toward the outer shell 20 is formed in the inner shell 22. The recess 38 forms the viewing window 11, with its interior space corresponding to the intermediate space 37 which serves to receive a decorative material. The wall 39, 39*a* is not joined to the inner shell 22 on its side which runs parallel to a longitudinal border 40 of the recess 38 or of the viewing window 11. An insertion slot 42 for the decorative material is thereby formed. In order to make it easier to remove the decorative material from the intermediate space 37, in the exemplary embodiment according to the figure the wall 39 is passed through by two elongated holes 43 which are spaced apart in the longitudinal direction 17 of the upper part 2. Via said elongated holes, the decorative material is accessible, for example by means of one finger, and can be pushed out of the intermediate space 37.

In the exemplary embodiment shown in FIGS. 15 to 18, the wall 39*a* is designed differently. It is likewise not joined to the inner shell 22 in the region of the longitudinal border 40 of the viewing window 11 or of the recess 38. However, this also applies to the transverse borders 44 of the viewing window 11 or of the recess 38. The wall 39*a* is therefore joined to the inner shell only on one side, namely on a side 45 which extends parallel to the second longitudinal border 40*a*. In this case, the corresponding connecting region 46 acts as a film hinge i.e. the wall 39*a* can be pivoted away from the inner shell 22 approximately in the direction of the arrow 47 (FIG. 18), as a result of which the insertion slot 42 is substantially enlarged. This facilitates the fitting and the removal of a decorative material in the region of the viewing window 11. The wall 39*a* is returned into the starting position, approximately corresponding to FIGS. 17 and 18, by means of elastic resetting forces. The fixing of a decorative material, in particular in the longitudinal direction 17 of the upper part 2, is ensured by cross-sectionally L-shaped holding strips 48 which are integrally formed on the transverse borders 44 of the recess 38.

Figure 11:
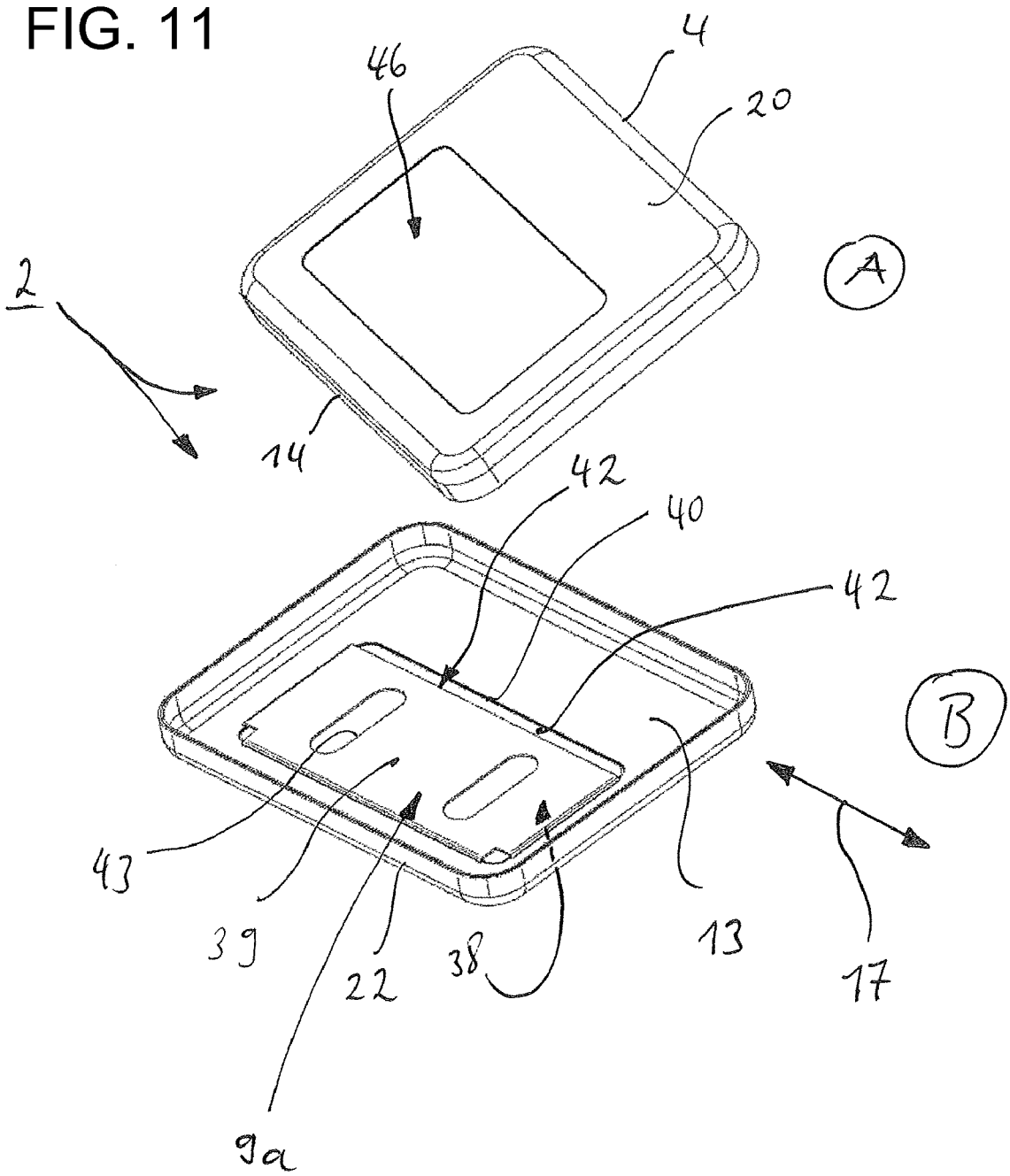
FIG. 11 shows an upper part which is formed from an outer shell (A) and inner shell (B) and in which a holding device for a decorative material is joined integrally to the inner shell.
Figure 13:
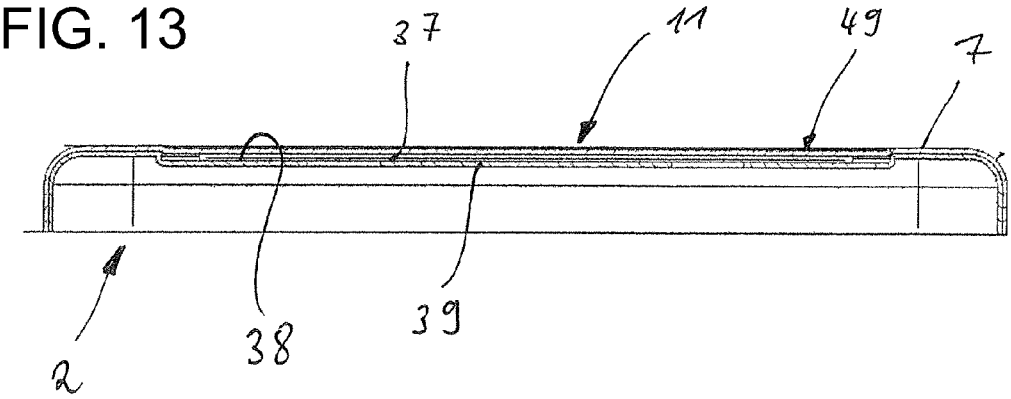
FIG. 13 is a section taken along the line XIII-XIII in FIG. 12.
Figure 12:
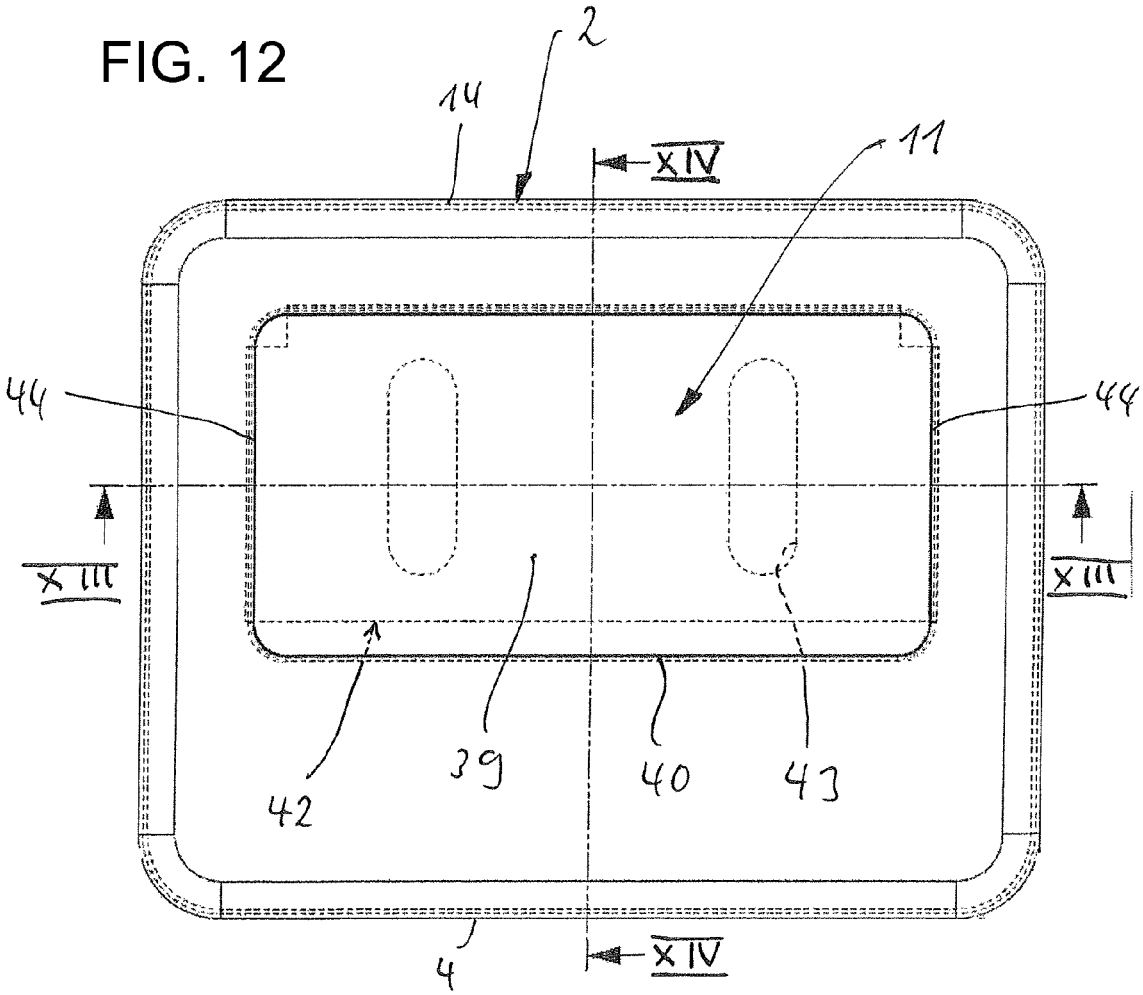
FIG. 12 shows a top view of an upper part from the outer side thereof.
Figure 14:
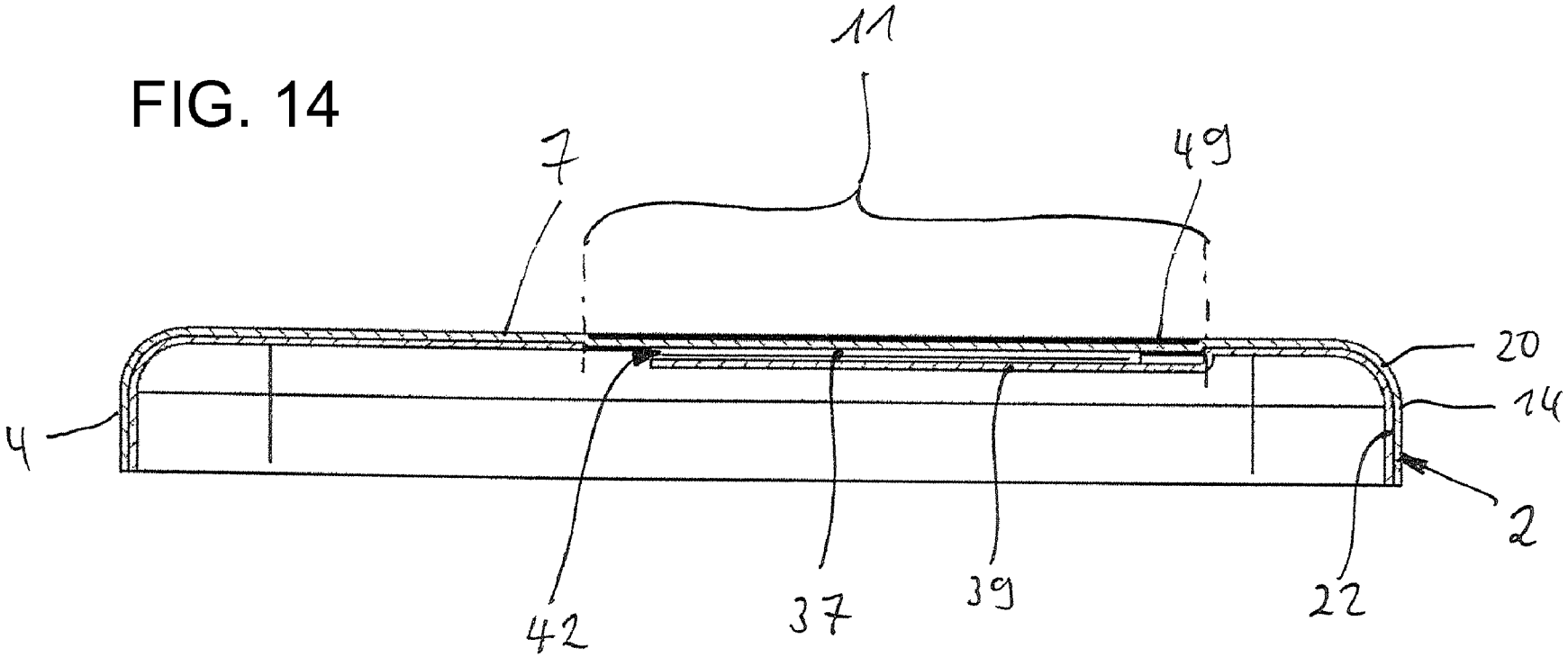
FIG. 14 shows a section corresponding to the line XIV-XIV.
Figure 15:
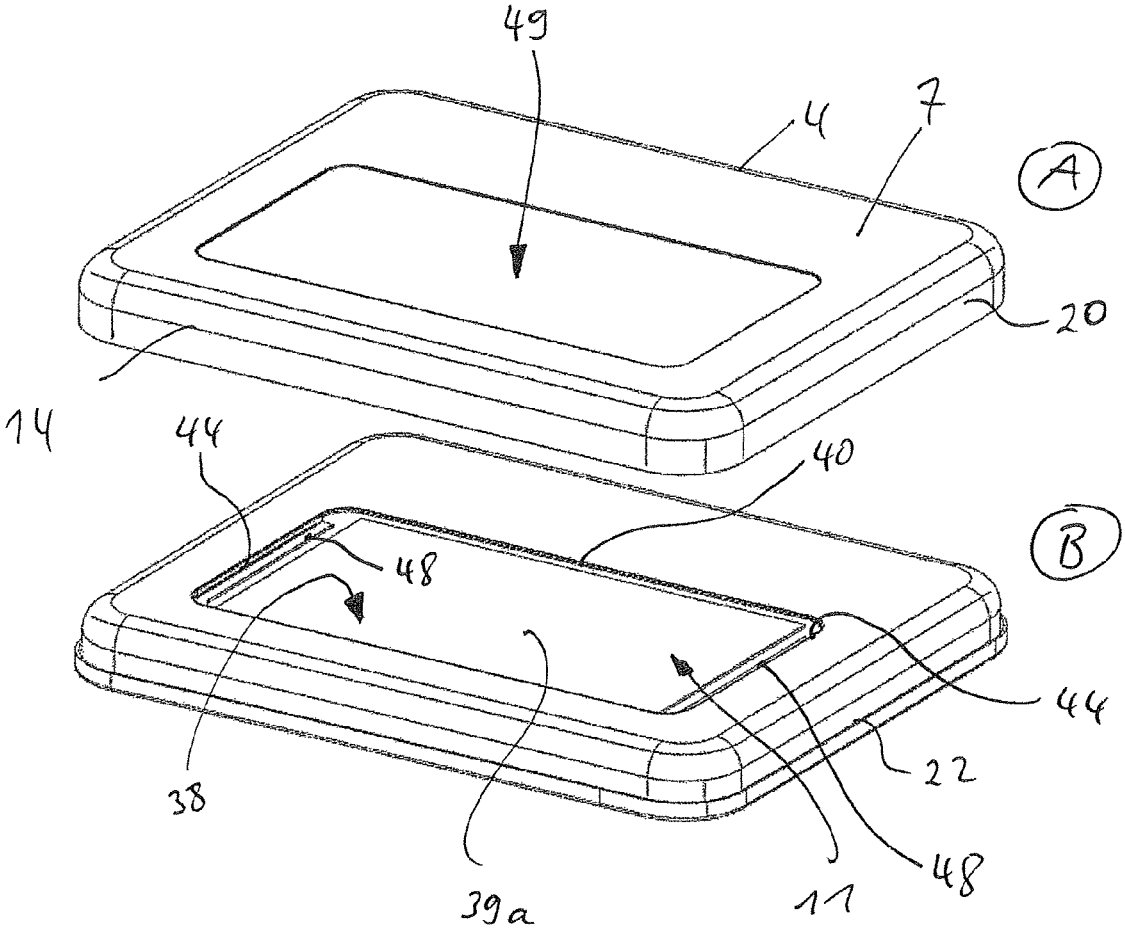
FIG. 15 shows a further exemplary embodiment of an upper part comprising outer shell (A) and inner shell (B)
Figure 16:
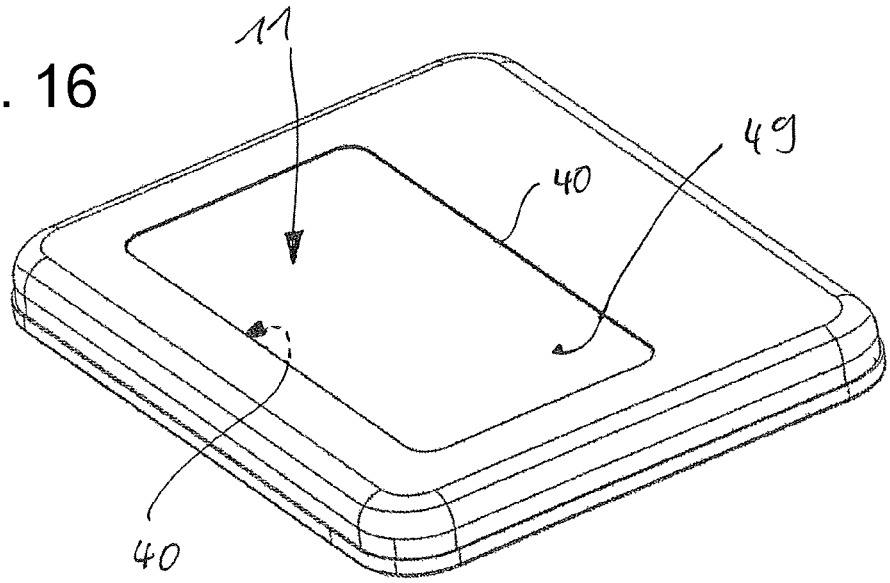
FIG. 16 shows the upper part of FIG. 15 in a perspective illustration, with a view of its outer side.
Figure 18:
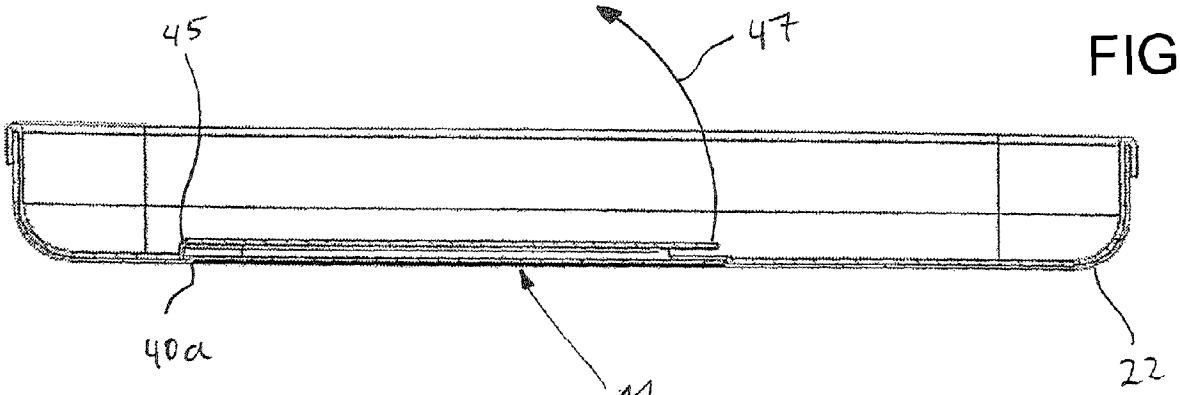
FIG. 18 is a section taken along the line XVIII-XVIII in FIG. 17.
Figure 17:
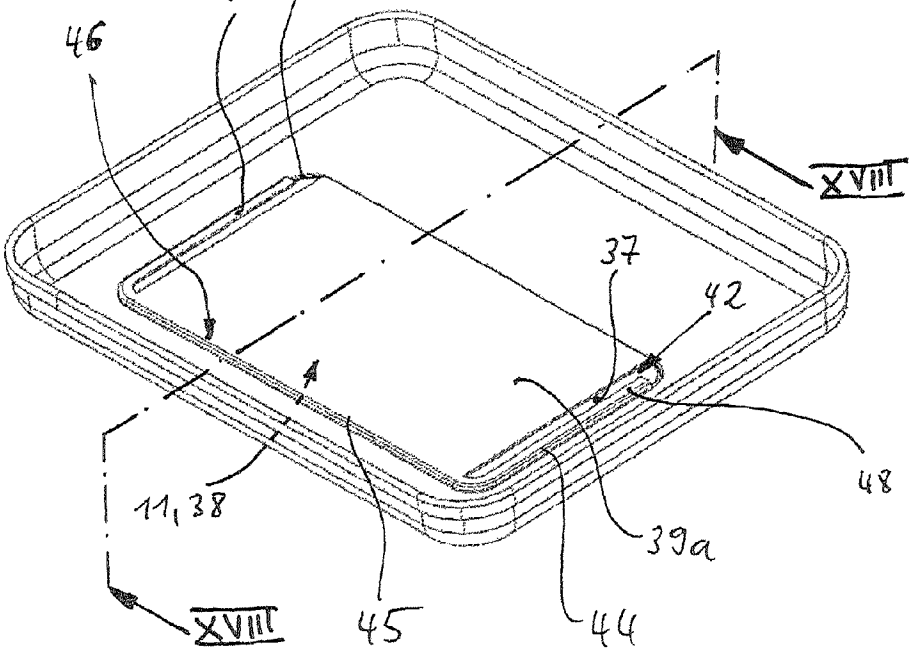
FIG. 17 shows the upper part of FIG. 16 in a perspective illustration, with a view of its inner side.

The rectangular contour visible on the outer shell 20 of FIGS. 4, 11 and 15 is a depression 49, the contour shape and size of which corresponds to the viewing window 11 formed in the inner shell 22 by means of an opening 23 or a recess 38

The invention claimed is:

1. A case, comprising:

a shell-shaped lower part and a shell-shaped upper part connected to said lower part;

said upper part having a viewing window formed therein, said upper part being formed of two shells, including an outer shell composed of a transparent material and an inner shell, said inner shell having a lower degree of transparency than said outer shell, said inner shell being broken through by an opening forming said viewing window; and a holding device for a decorative material blank disposed on an inner side of said upper part and substantially covering said viewing window on an inside thereof.

2. The case according to claim 1, wherein said holding device has a separate film blank fixed to the inner side of said upper part, with a space formed between said film blank and said viewing window for receiving the decorative material blank.

3. The case according to claim 1, wherein said holding device is a separate insertion pocket fixed to the inner side of said upper part, and said insertion pocket is formed of two film blanks with an interior space serving to receive the decorative material.

4. The case according to claim 3, wherein said holding device is dimensioned to receive a decorative material blank having a length and a width dimension greater than a corresponding length and width dimension, respectively, of said viewing window.

5. The case according to claim 2, wherein said holding device is dimensioned to receive a decorative material blank having a length and a width dimension greater than a corresponding length and width dimension, respectively, of said viewing window.

6. The case according to claim 1, wherein said holding device is a wall integrally formed on the inner side of said upper part, running substantially parallel to a flat plane of said upper part, and leaving free an intermediate space between said wall and the inner side of said upper part serving to receive the decorative material.

7. The case according to claim 1, wherein said upper part is a thermoformed part made of plastic.

8. The case according to claim 1, configured for holding and transporting writing utensils.

* * * * *